US008636058B2

(12) United States Patent
Nguyen et al.

(10) Patent No.: US 8,636,058 B2
(45) Date of Patent: Jan. 28, 2014

(54) STRAIGHT-BORE BACK PRESSURE VALVE

(75) Inventors: Dennis P. Nguyen, Pearland, TX (US); Maria R. Contreras, Houston, TX (US)

(73) Assignee: Cameron International Corporation, Houston, TX (US)

( * ) Notice: Subject to any disclaimer, the term of this patent is extended or adjusted under 35 U.S.C. 154(b) by 301 days.

(21) Appl. No.: 12/920,826

(22) PCT Filed: Mar. 19, 2009

(86) PCT No.: PCT/US2009/037731
§ 371 (c)(1),
(2), (4) Date: Sep. 2, 2010

(87) PCT Pub. No.: WO2009/126420
PCT Pub. Date: Oct. 15, 2009

(65) Prior Publication Data

US 2011/0011575 A1 Jan. 20, 2011

Related U.S. Application Data

(60) Provisional application No. 61/043,580, filed on Apr. 9, 2008.

(51) Int. Cl.
*E21B 34/02* (2006.01)

(52) U.S. Cl.
USPC ..... 166/97.1; 166/87.1; 166/325; 166/332.1

(58) Field of Classification Search
USPC ..... 166/373, 386, 96.1, 87.1, 97.1, 325, 166/332.1, 206, 216, 118, 88.3, 95.1
See application file for complete search history.

(56) References Cited

U.S. PATENT DOCUMENTS

| | | | | | |
|---|---|---|---|---|---|
| 2,032,492 | A | * | 3/1936 | Nathan | 277/615 |
| 2,139,983 | A | * | 12/1938 | Stone | 166/120 |
| 2,331,532 | A | | 10/1943 | Bassinger | |
| 2,589,506 | A | | 3/1952 | Morrisett | |
| 2,958,336 | A | * | 11/1960 | Yancey | 137/879 |
| 3,152,643 | A | * | 10/1964 | Burns | 166/124 |
| 4,395,809 | A | * | 8/1983 | Whiteley | 29/451 |
| 4,478,279 | A | * | 10/1984 | Puntar et al. | 166/121 |
| 4,825,945 | A | * | 5/1989 | Smith | 166/87.1 |
| 4,934,459 | A | * | 6/1990 | Baugh et al. | 166/380 |

(Continued)

FOREIGN PATENT DOCUMENTS

| | | |
|---|---|---|
| EP | 1555386 | 7/2005 |
| GB | 2291449 | 1/1996 |
| WO | 2009067298 A1 | 5/2009 |

OTHER PUBLICATIONS

PCT International Search Report and Written Opinion for PCT/US2009/037731, dated Sep. 4, 2009.

(Continued)

*Primary Examiner* — Jennifer H Gay
(74) *Attorney, Agent, or Firm* — Fletcher Yoder, P.C.

(57) ABSTRACT

A system includes a back pressure valve. The back pressure valve includes a body, a plunger disposed internal to the body, and a friction member disposed about the exterior of the body. The friction member is configured to expand radially to contact an internal surface of a bore. A method includes disposing a back pressure valve into a straight bore and expanding a friction member of the back pressure valve radially into contact with an internal surface of the straight bore.

32 Claims, 6 Drawing Sheets

(56) References Cited

U.S. PATENT DOCUMENTS

| | | | | |
|---|---|---|---|---|
| 5,020,590 | A * | 6/1991 | McLeod | 166/77.4 |
| 5,058,672 | A | 10/1991 | Cochran | |
| 5,170,845 | A * | 12/1992 | Gay et al. | 166/374 |
| 5,201,371 | A * | 4/1993 | Allen | 166/325 |
| 5,320,181 | A * | 6/1994 | Lantier et al. | 166/386 |
| 5,501,280 | A * | 3/1996 | Brisco | 166/373 |
| 5,782,297 | A * | 7/1998 | Samuels et al. | 166/85.1 |
| 5,857,524 | A * | 1/1999 | Harris et al. | 166/382 |
| 6,497,291 | B1 * | 12/2002 | Szarka | 166/386 |
| 7,117,737 | B2 * | 10/2006 | Sallee et al. | 73/273 |
| 7,308,934 | B2 * | 12/2007 | Swagerty et al. | 166/177.5 |
| 7,383,891 | B2 | 6/2008 | Fay et al. | |
| 7,533,728 | B2 * | 5/2009 | Winslow et al. | 166/318 |
| 7,934,550 | B2 * | 5/2011 | Bolding et al. | 166/263 |
| 2006/0102361 | A1 | 5/2006 | Fay et al. | |
| 2008/0001111 | A1 * | 1/2008 | Ross | 251/230 |
| 2008/0169097 | A1 * | 7/2008 | Bolding et al. | 166/263 |
| 2010/0258319 | A1 * | 10/2010 | Nguyen et al. | 166/373 |
| 2011/0011575 | A1 * | 1/2011 | Nguyen et al. | 166/87.1 |
| 2011/0079399 | A1 * | 4/2011 | Nguyen et al. | 166/373 |
| 2011/0114321 | A1 * | 5/2011 | Guidry et al. | 166/308.1 |

OTHER PUBLICATIONS

Great Britain Examination Report for GB Application No. GB1016480.4 dated Jan. 31, 2012.

Great Britain Examination Report for GB Application No. GB1016480.4 dated Aug. 7, 2012.

Great Britain Examination Report for GB Application No. GB1219398.3 dated Nov. 29, 2012.

Great Britain Examination Report for GB Application No. GB1016480.4 dated Dec. 18, 2012.

* cited by examiner

STRAIGHT-BORE BACK PRESSURE VALVE

CROSS-REFERENCE TO RELATED APPLICATIONS

This application claims priority to PCT Application No. PCT/US2009/037731 entitled "Straight-Bore Back Pressure Valve", filed on Mar. 19, 2009, which is herein incorporated by reference in its entirety, and which claims priority to U.S. Provisional Patent Application No. 61/043,580, entitled "Straight-Bore Back Pressure Valve", filed on Apr. 9, 2008, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are employed to access and extract the resource. These systems can be located onshore or offshore depending on the location of a desired resource. Further, such systems generally include a wellhead assembly that is used to extract the resource. These wellhead assemblies include a wide variety of components and/or conduits, such as various control lines, casings, valves, and the like, that are conducive to drilling and/or extraction operations. In drilling and extraction operations, in addition to wellheads, various components and tools are employed to provide for drilling, completion, and the production of mineral resources. For instance, during drilling and extraction operations seals and valves are often employed to regulate pressures and/or fluid flow.

A wellhead system often includes a tubing hanger or casing hanger that is disposed within the wellhead assembly and configured to secure tubing and casing suspended in the well bore. In addition, the hanger generally regulates pressures and provides a path for hydraulic control fluid, chemical injections, or the like to be passed through the wellhead and into the well bore. In such a system, a back pressure valve is often disposed in the hanger bore and/or a similar bore of the wellhead. The back pressure valve plugs the bore to block pressures of the well bore from manifesting through the wellhead.

Typically, the back pressure valve is provided separately from the hanger, and is installed after the hanger has been landed in the wellhead assembly. In other words, the hanger is run down to the wellhead, followed by the installation of the back pressure valve. One resulting challenge includes installing the back pressure valve into the hanger bore in context of high pressures in the bore. Accordingly, installation of the back pressure valve may include the use of several tools and a sequence of procedures to set and lock the seal. Unfortunately, each of the sequential running procedures may consume a significant amount of time and money. Further, securing the back pressure valve generally includes complementary engagement features in the bore itself. The bore typically includes shoulders, grooves, notches, or similar features that are engaged by portions of the back pressure valve. Thus, the design of the bore is configured to accommodate a specific back pressure valve design. Typically, the back pressure valve and bore are designed specifically for use with one another, thereby, adding yet another level of complexity to the overall design of the wellhead.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present technique include a system and method that each addresses one or more of the above-mentioned inadequacies of conventional sealing systems and methods. As explained in greater detail below, the disclosed embodiments include a back pressure valve that can be installed into a straight bore. More specifically, the back pressure valve is installed into a portion of a bore that does not include engagement features to secure the back pressure valve in the bore. Accordingly, the back pressure valve is secured against the generally smooth/flat walls of the bore, as opposed to grooves, shoulders, or similar features that are typically employed to secure a back pressure valve, or a similar valve, in a bore. As a result, the exemplary back pressure valve may be inserted into a large variety of tubing hangers with varying bore profiles. In certain embodiments, the back pressure valve includes a friction member that is expanded radially to secure the back pressure valve into the bore. In some embodiments, the friction member is moved longitudinally via hydraulic pressure exerted on an outer sleeve, and/or secured in a locked position via a locking ring that is rotated into position to block the outer sleeve in position when the hydraulic pressure is reduced. Before discussing embodiments of the system in detail, it may be beneficial to discuss a system that may employ such a back pressure valve.

Figure 1:
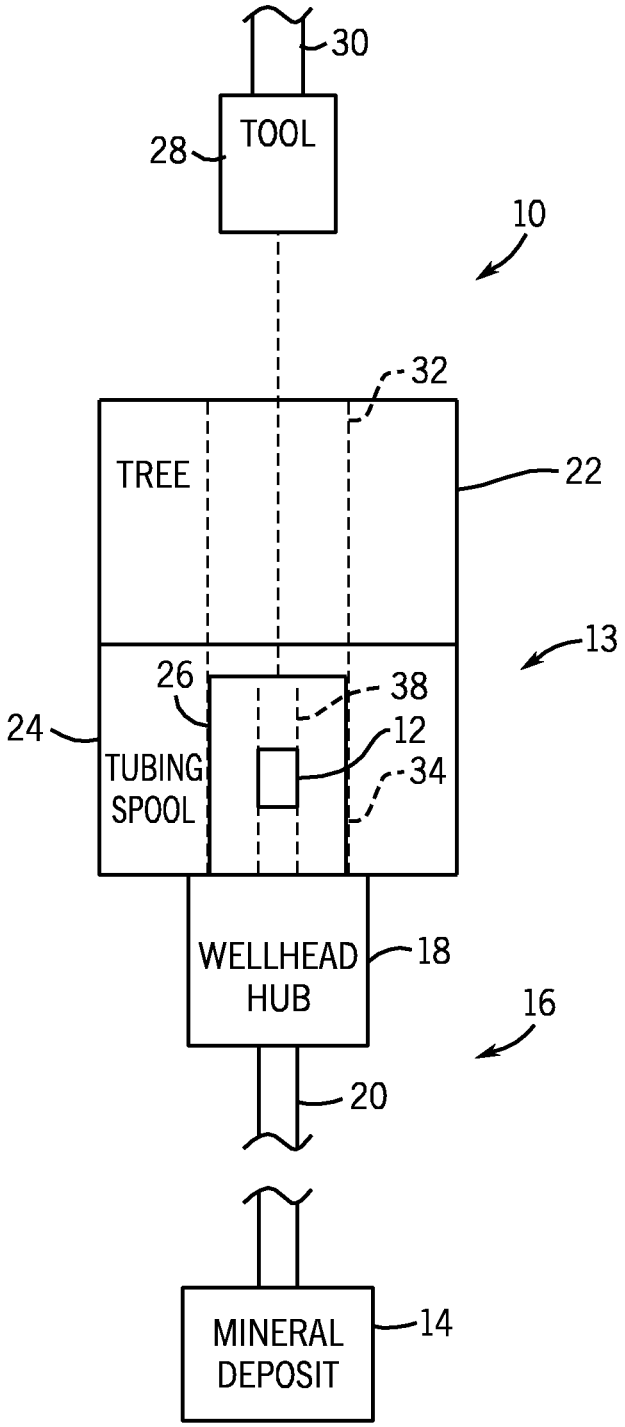
FIG. 1 is a block diagram that illustrates a mineral extraction system in accordance with an embodiment of the present technique.

FIG. 1 is a block diagram that illustrates a mineral extraction system 10 including a back pressure valve (BPV) 12 in accordance with embodiments of the present technique. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). In the illustrated embodiment, the system 10 includes a wellhead 13 coupled to a mineral deposit 14 via a well 16, wherein the well 16 includes a wellhead hub 18 and a well-bore 20.

The wellhead hub 18 generally includes a large diameter hub that is disposed at the termination of the well bore 20. The wellhead hub 18 provides for the connection of the wellhead 13 to the well 16. In some embodiments, the wellhead 13 includes a connector that is coupled to a complementary connector of the wellhead hub 18. For example, in one embodiment, the wellhead hub 18 includes a DWHC (Deep Water High Capacity) hub manufactured by Cameron, headquartered in Houston, Tex., and the wellhead 13 includes a complementary collet connector (e.g., a DWHC connector), also manufactured by Cameron.

The wellhead 13 typically includes multiple components that control and regulate activities and conditions associated with the well 16. In some embodiments, the wellhead 13 generally includes bodies, valves and seals that route produced minerals from the mineral deposit 14, provides for regulating pressure in the well 16, and provides for the injection of chemicals into the well bore 20 (down-hole). For example, in the illustrated embodiment, the wellhead 13 includes what is colloquially referred to as a christmas tree 22 (hereinafter, a tree), a tubing spool 24, and a hanger 26 (e.g., a tubing hanger or a casing hanger). The system 10 may include other devices that are coupled to the wellhead 13, and devices that are used to assemble and control various components of the wellhead 13. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead 13. In other embodiments, such as surface systems, the tool 28 may include a device suspended over and/or lowered into the wellhead 13 via a crane or other supporting device.

The tree 22 generally includes a variety of flow paths (e.g., bores), valves, fittings, and controls for operating the well 16. For instance, in some embodiments, the tree 22 includes a frame that is disposed about a tree body, a flow-loop, actuators, and valves. Further, the tree 22 generally provides fluid communication with the well 16. For example, in the illustrated embodiment, the tree 22 includes a tree bore 32. The tree bore 32 provides for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) are generally regulated and routed via the tree 22. For instance, the tree 22 may be coupled to a jumper or a flowline that is tied back to other components, such as a manifold. Accordingly, in such an embodiment, produced minerals flow from the well 16 to the manifold via the wellhead 13 and/or the tree 22 before being routed to shipping or storage facilities.

The tubing spool 24 provides a base for the wellhead 24 and/or an intermediate connection between the wellhead hub 18 and the tree 22. Typically, the tubing spool 24 (also referred to as a tubing head) is one of many components in a modular subsea or surface mineral extraction system 10 that are run from an offshore vessel and/or a surface installation system. As illustrated, the tubing spool 24 includes the tubing spool bore 34. The tubing spool bore 34 connects (e.g., enables fluid communication between) the tree bore 32 and the well 16. Thus, the tubing spool bore 34 provides access to the well bore 20 for various completion procedures, worker procedures, and the like. For example, components can be run down to the wellhead 13 and disposed in the tubing spool bore 34 to seal-off the well bore 20, to inject chemicals down-hole, to suspend tools down-hole, and/or to retrieve tools from down-hole.

As will be appreciated, the well bore 20 may contain elevated pressures. For instance, in some systems, the well bore 20 may include pressures that exceed 10,000 pounds per square inch (PSI), that exceed 15,000 PSI, and/or that even exceed 20,000 PSI. Accordingly, mineral extraction systems 10 typically employ various mechanisms, such as seals, plugs and valves, to control and regulate the well 16. In some instances, plugs and valves are employed to regulate the flow and pressures of fluids in various bores and channels throughout the mineral extraction system 10. The illustrated hanger 26 (e.g., tubing hanger or casing hanger), for example, is typically disposed within the wellhead 13 to secure tubing and casing suspended in the well bore 20, and to provide a path for hydraulic control fluid, chemical injections, and the like. The hanger 26 includes a hanger bore 38 that extends through the center of the hanger 26, and that is in fluid communication with the tubing spool bore 34 and the well bore 20. Unfortunately, if left unregulated, pressures in the bores 20 and 34 can manifest through the wellhead 13. Accordingly, the back pressure valve (BPV) 12 is often seated and locked in the hanger bore 38 to regulate the pressure. Valves similar to the illustrated back pressure valve 12 can be used throughout the mineral extraction system 10 to regulate fluid and/or gas pressures and flow paths.

In the context of the hanger 26, the back pressure valve 12 can be installed into the hanger 26, or a similar location, before the hanger 26 is installed in the wellhead 13, or may be installed into the hanger 26 after the hanger 26 has been installed in the wellhead 13 (e.g., landed in the tubing spool bore 34). In the latter case, the hanger 26 is typically run down and installed into the subsea wellhead 13 (or a similar surface wellhead), followed by the installation of the back pressure valve 12. During installation of the back pressure valve 12, pressure in the well bore 20 may exert a force (e.g., a back-pressure) on the lower portion of the back pressure valve 12. Unfortunately, the backpressure may increase the difficulty of installing the back pressure valve 12. For example, the back-pressure may resist the installation of the back pressure valve 12. Although typical embodiments of the hanger bore 38 include shoulders, grooves, notches, or similar features that are engaged by portions of the back pressure valve 12, in embodiments of the system 10, the back pressure valve 12 is disposed in a portion of the hanger bore 38 that is a straight bore. Accordingly, the system and methods discussed in greater detail below provide a system and method including disposing the back pressure valve 12 in the straight hanger bore 38, and/or a similar straight bore (e.g., a tubing or casing pipe bore).

Figure 2:
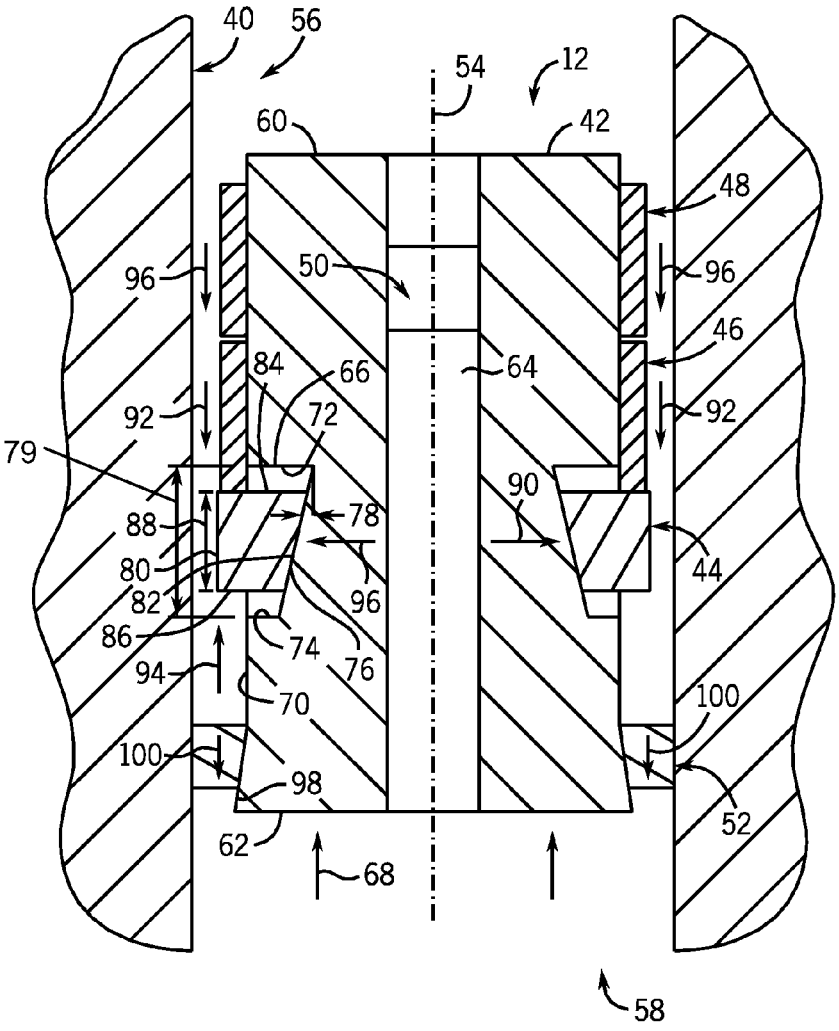
FIG. 2 is a block diagram that illustrates a back pressure valve in accordance with an embodiment of the present technique.

FIG. 2 is a block diagram that illustrates an embodiment of the back pressure valve (BPV) 12 disposed in a bore 40 in accordance with embodiments of the present techniques. In the illustrated embodiment, the BPV 12 includes a body 42, a friction member 44, an outer sleeve 46, a lock ring 48, a plunger 50, and a seal 52.

The bore 40 includes a straight bore (e.g., a full-bore). A straight bore can be defined as a bore having an internal diameter including generally constant or uniform surfaces that do not include engagement/retention features such as shoulders, grooves, notches, or the like. For example, in some embodiments, the internal surface of the bore includes straight or flat walls that are generally parallel to a longitudinal axis of the bore. In some embodiments, the bore 40 includes a generally cylindrical bore formed from casing, tubing, or a bore internal to the system 10, such as the hanger bore 38. For example, in one embodiment, the bore 40 includes the hanger bore 38, or a similar bore (e.g., a tubing or casing pipe bore), having a generally consistent internal diameter along its length.

Further, in one embodiment the bore 40 is straight along its entire length, whereas in other embodiment, the bore 40 is straight along some portion but not all of its length. For example, the bore 40 is straight at least in the portion of the bore 40 where the BPV 12 is seated, in one embodiment. In such an embodiment, other portions of the bore 40 may include engagement features that are configured for securing other valves and tools, for instance.

The surface of the bore 40 generally does not include any significant physical features or preparation, in some embodiments. For example, in one embodiment, the bore 40 includes a smooth unfinished surface. This includes the standard finish of the body that forms the bore 40, such as, for example, the interior of the casing, the tubing, and the hanger bore 38. However, in other embodiments, the internal surface of the bore 40 includes a modified surface. In other words, the internal surface of the bore 40 includes some form of preparation of the surface, but still does not include engagement/retention features, such as shoulders, grooves, notches, or the like. In one embodiment, the modified surface includes a scored surface, or otherwise coarse finish to encourage friction (e.g., increase the coefficient of friction) between the internal surface of the bore 40 and complementary features of the BPV 12. In another embodiment, the modified surface includes polishing, smoothing, or otherwise preparing the surface for contact with the back pressure valve 12.

In the illustrated embodiment, the bore 40 includes a longitudinal axis 54 running the length of the bore 40. In operation, the BPV 12 is located along the longitudinal axis 54 and regulates pressures between an upper bore portion 56 and a lower bore portion 58. The upper bore portion (e.g., a downstream and bore portion) 56 includes a portion of the bore 40 toward an upper end of the wellhead 13 and the lower bore portion (e.g., a downstream bore portion) 58 includes a portion of the bore 40 that is on an opposite end of the well-head 13. For example, the lower bore portion 58 includes an end exposed and/or in the direction of the well-bore 20 and/or the mineral deposit 14, in certain embodiments.

The body 42 of the BPV 12 includes an upper end 60 (e.g., downstream end), a lower end 62 (e.g., upstream end), a plunger bore 64, and a recess 66. The upper end 60 of the body 42 generally is exposed to and faces the upper bore portion 56 when installed. Similarly, the lower end 62 of the body generally is exposed to and faces the lower bore portion 58. Accordingly, when installed, the lower end of the BPV 12 is exposed to the pressures associated with the lower bore portion 58. These pressures typically include pressures from the well bore 20, the mineral deposit 14, fluids and gases injected down-hole and the like. The pressures generally act on the lower end 62 in the direction of the arrows 68 (e.g., toward the upper bore portion 56).

The plunger bore 64 includes a bore that extends through the length of the body 42 of the BPV 12. The plunger bore 64 generally includes a path for the regulation of pressure between the upper bore portion 56 and the lower bore portion 58. For example, when opened (e.g., not occluded) fluids and gases on either side of the BPV 12 can flow back and forth to maintain a balanced pressure between the upper bore portion 56 and the lower bore portion 58. This may be particularly useful during installation and removal of the BPV 12 when the pressure is balanced to enable moving of the BPV 12 within the bore 40 and along the longitudinal axis 54 without additional loading to overcome the longitudinal forces, such as those acting on the lower end 62 of the BPV 12. When closed (e.g., occluded) the BPV 12 generally occludes the bore to maintain a pressure differential between the upper bore portion 56 and the lower bore portion 58. More specifically, in an embodiment in which the plunger 50 includes a unilateral check valve, the BPV 12 is typically configured to retain an elevated pressure in the lower bore portion 58.

As mentioned briefly above, the plunger 50 is typically employed to regulate the flow of fluids and gases through the BPV 12. More specifically, the plunger 50 includes an open position and a closed position in certain embodiments. For example, in one embodiment, the plunger 50 includes a sealing portion (e.g., a bell) that is configured to engage a complementary sealing surface or feature in the plunger bore 64. In a closed position, the sealing portion of the plunger 50 engages the sealing surface/feature in the plunger bore 64 to occlude the plunger bore 64. In an open position, the sealing portion of the plunger 50 is urged/located away from the sealing surface of the plunger bore 64, thereby enabling fluid and gases to pass through the plunger bore 64. Certain embodiments of the plunger 50 and the plunger bore 64 are discussed in more detail below with regard to FIGS. 3 and 4A-4E.

The recess 66 generally includes one or more indentations in an external surface 70 of the body 42. In one embodiment, the recess 66 includes a single groove about an external surface (e.g., circumference) 70 of the body 42. In other embodiments, the recess 66 includes one or more separate recessed sections about the external surface 70 of the body 42. In the illustrated embodiment, the recess 66 includes a groove that extends around the circumference of the body 42 and that includes an upper face 72, a lower face 74 and an internal face 76. The internal face 76 includes an angle (e.g., a taper) relative to the longitudinal axis 54, in the illustrated embodiment. For example, the internal face 76 includes a smaller diameter proximate the upper face 72 and the upper end 60 of the body 42, and includes a larger diameter proximate the lower face 74 and the lower end 62 of the body 24 (e.g., a conical section of the body 42). In other words, the internal face 76 includes a taper that increases in diameter from the upper face 72 to the lower face 74. Thus, the internal face 76 is oriented at an angle 78 relative to the longitudinal axis 54. As is discussed in greater detail below, the angle 78 may include any angle suitable for expanding the friction member 44. For example, in one embodiment, the angle 78 is between about 5 degrees and 10 degrees. However, in other embodiments, the angle 78 may be greater than about 10 degrees or less than about 5 degrees. Further, a height 79 of the recess 66 is defined by the distance between the upper face 72 and the lower face 74.

The friction member 44 generally includes one or more devices that are employed to secure the BPV 12 to the bore 40. More specifically, in some embodiments, the friction member 44 includes one or more members (discussed in more detail below) that are expanded in a radial manner/direction to contact the walls of the bore 40, thereby securing the BPV 12 to the bore 40. In certain embodiments, an outer surface (e.g., friction surface) of the friction member 44 directly contacts a straight portion of the bore 40, thereby securing the BPV 12 in the bore without the aid of any engagement/retention features, such as shoulders, grooves, notches, or the like.

In the illustrated embodiment, the friction member 44 includes a friction face 80, an internal face 82, an upper face 84, and a lower face 86. The upper face 84 and lower face 86 are proximate the upper face 72 and lower face 74, respectively, of the recess 66 in the body 42. As depicted in the illustrated embodiment, a height 88 (e.g., the distance between the upper face 84 and the lower face 86) of the friction member 44 is less than the height 79 of the recess 66. Accordingly, in one embodiment, the friction member 44 is capable of moving longitudinally (e.g., a long the longitudinal axis 54) relative to the recess 66 and the body 42 of the BPV 12.

The internal face 82 generally includes a profile that is complementary to the profile of the internal face 72 of the body 42. In the illustrated embodiment, for example, the internal face 82 of the friction member 44 includes a taper that is complementary to the taper (angle 78) of the internal face 76. In other words, the internal face includes a profile (taper) that increases in diameter from the upper face 84 to the lower face 86. Accordingly, in one embodiment, movement of the friction member 44 in a longitudinal direction (e.g., along the longitudinal axis 54) relative to the body 42 and the recess 66 causes the friction member to expand and/or contract radially. For example, in an embodiment where the friction member 44 is located proximate the upper face 72 of the recess 66 and urged toward the lower face 74 of the recess 66, the friction member 44 expands radially in the direction of the arrows 90. As is discussed below, the urging force to displace the friction member 44 can be provided downward on the friction member 44 (e.g., from the outer sleeve 46) or upward on the body 42 (e.g., the pressure acting on the lower end 62 of the body 42), in certain embodiments. In one embodiment, force may be applied in the opposite direction to urge the friction member 44 upward (e.g., toward the upper face 72 of the recess 66 and urge the friction member inward, in a direction opposite the arrows 90. Further, it will be appreciated that although the illustrated embodiment includes urging the friction member downward (e.g., toward the lower face 74 and toward the lower bore portion 58) to expand the friction member radially, other embodiments include a similar configuration wherein urging the friction member 44 in an upward direction expands the friction member 44 radially. For example, the taper can be reversed in one embodiment such that the diameter is larger proximate the upper face 72 of the recess 66 and smaller proximate the lower face 74. In any of the embodiments, expanding the friction member 44 causes the friction face 80 of the friction member 44 to contact the internal surface of the bore 40.

The friction face 80 includes the face located on the outside of the friction member 44. Generally, the friction face 80 contacts the walls of the bore 40 when the friction member 44 is expanded in a radial direction, represented by the arrows 90. In certain embodiments, the friction face 80 includes one or more surface features conducive to securing the friction member 44, and, thus, the BPV 12 to the bore 40. Generally, the friction face 80 includes a surface that provides a coefficient of friction sufficient to secure the BPV 12 in the bore 40 in light of the pressures experienced across the BPV 12. For example, in one embodiment, the friction face 80 includes a coarse finish. The coarse finish is provided by scoring, or sanding the friction face 80, in one embodiment. In another embodiment, the coarse finish is provided by coating the friction face 80 with a composite material. For example, the friction face 80 includes a coating of a material having a hardness that is less than the hardness of the surface of the bore 40, in one embodiment.

In other embodiments, the surface features include indentations and/or patterns of indentations in the friction face 80. In one embodiment, the friction face 80 includes a plurality of grooves that provide localized areas of high surface contact forces when the friction member 44 is expanded radially against the surface of the bore 40. These localized areas of force enable the friction member 44 to bite into the interior of the bore 40. For example, in one embodiment, the indentations form rows and/or columns of teeth.

In some embodiments, the friction face 80 includes a generally flat and/or smooth surface. For example, in one embodiment, the friction face 80 includes an unfinished or polished surface. In such an embodiment, the increased contact area between the friction face 80 and the surface of the bore 40 provides the friction to secure the friction member 44 and the BPV 12 to the bore 40.

The friction face 80, in some embodiments, includes any combination of the surface features discussed above. For example, in one embodiment, the friction face 80 includes teeth like features in one region, a smooth finish in other regions, and a coating over at least a portion of the regions. In another embodiment, the friction face 80 includes a combination of recesses (e.g., teeth and grooves) and a coating, for example.

Further, the friction face 80 includes a profile that is conducive to generating a friction between the friction member 44 and the bore 40. In one embodiment, the friction face 80 includes a profile that is similar to the profile of the bore 40. For example, in the illustrated embodiment, the profile of the friction face 80 includes a surface that is in generally parallel to the surface of the bore 40. In other words, the surface of the friction face 80 includes at least a portion that is parallel to the longitudinal axis 54 (e.g., cylindrical exterior).

The friction member 44 is formed from one or more devices that are capable of being expanded radially, as discussed above. In some embodiments, the friction member 44 includes one or more rings, one or more segments, one or more locking dogs, or a combination thereof. For example, in one embodiment, the friction member 44 includes a C-ring that is positioned in the recess 66. In another embodiment, the C-ring includes one or more segments along its exterior that are configured to contact the surface of the bore 40. In such embodiments, the recess 66 may include a groove that extends around circumference of the body 42. In another embodiment, the friction member 44 includes one or more locking segments that are positioned in one or more recesses 66 about the circumferences. For example, in one embodiment, the segments are disposed about a single groove forming the recess 66. In another embodiment, the recess 66 includes a plurality of separate indentations that are configured to accept one or more of the segments forming the friction member 44. For example, the friction member 44 is formed form several segments that are not joined to one another in one embodiment. In another embodiment, the segments are coupled to one another by a common member. For example, in one embodiment, the friction ring 44 includes a plurality of segments coupled to a common ring. It will be appreciated that the friction member 44 may includes any mechanism or device configured to expand radially to provide a securing/friction force between the BPV 12 and an internal surface of the bore 40.

The outer sleeve 46 generally includes a device or mechanism that exerts a force on the friction member 44. More specifically, in certain embodiments, the outer sleeve 46 exerts a longitudinal force (e.g., a force parallel to the longitudinal axis 54) on the friction member 44 that causes the friction member 44 to expand radially. For example, in the illustrated embodiment, urging the outer sleeve 46 in the direction of arrows 92 generates an axial load on at least a portion of the upper face 84 of the friction member 44. The axial load urges the friction member 44 in the direction of the arrows 92, thereby causing radial expansion of the friction member 44, as discussed above. Although the outer sleeve 46 is located above the friction member 44 in the illustrated embodiment, all or at least a portion of the outer sleeve 46 may be located below the friction member 44 in other embodiments. For example, in an embodiment where an axial load is delivered to the lower face 86 of the friction member 44, at least a portion of the outer sleeve may be located below the friction member 44. For example, as discussed in greater detail below with regard to FIGS. 3- and 4A-4E, a portion of the outer sleeve 46 is located below the friction member 44 to provide a force in the direction of arrows 94 to enable the friction member 44 to contract radially. In another embodiment, for example, the embodiment in which the taper is reversed, the axial force in the direction of the arrows 94 is employed to expand the friction member 44 radially.

The axial force provided by the outer sleeve is generated by hydraulic loading in some embodiments. For example, although not depicted in FIG. 3, as discussed in greater detail below with regard to FIGS. 3 and 4A-4E, the BPV 12 includes a hydraulic port that terminates in a chamber proximate the outer sleeve 46 such that energizing the hydraulic port and chamber exerts a force on the outer sleeve 46 in the direction of the arrows 92, thereby providing the axial loading on the friction member 44. Other embodiments may include similar forms of loading. For example, in one embodiment, the outer sleeve 46 is threaded to the body 42, such that rotation of the outer sleeve 46 generates the axial force in the direction of the arrows 92.

The lock ring 48 secures the position of outer sleeve 46 and, thus, the position of the friction member 44, in certain embodiments. In one embodiment, the lock ring 48 is positioned against the outer sleeve 46 to block the outer sleeve 46 from moving upward (e.g., in the opposite direction of the arrows 92). For example, in one embodiment, the lock ring 48 is threaded to the body 42 such that rotation of the lock ring 48 urges the locking ring downward (e.g., in the direction of the arrows 96), and toward the outer sleeve 46. In another embodiment, the lock ring 48 is urged into movement via a hydraulic arrangement similar to that discussed above with regard to the outer sleeve 46. Accordingly, the lock ring 48 is urged/moved along the longitudinal axis 54 until it abuts the outer sleeve 46, thereby securing the outer sleeve 46 in a position. In one embodiment, the outer sleeve 46 is secured in a locked position (e.g., a position holding the friction member 44 in the radially expanded position), for instance. In one embodiment, hydraulic pressure is employed to urge the outer sleeve 46 into engagement with the friction member 44. The lock ring 48 is rotated until it is proximate or abutting the outer sleeve 46, and the hydraulic pressure is released. With the hydraulic pressure is released, the outer sleeve 46 is blocked from moving a significant longitudinal distance by the lock ring 48. Thus, the friction member 44 is held in position (e.g., an expanded position) via the outer sleeve 46 and the lock ring 48.

In some embodiments, the BPV 12 includes one or more additional seals that block/regulate the pressures between the lower bore portion 58 and the upper bore portion 56. For instance, in the illustrated embodiment, the BPV 12 includes a seal 52 disposed between the body 42 and the internal surface of the bore 40. In one embodiment, the seal 52 includes a mechanical (e.g., MEC) seal. In another embodiment, the seal 52 includes an elastomer seal or similar seal.

The seal 52, in some embodiments, is compressed within a region between the body 42 and the surface of the bore 40. For example, in the illustrated embodiment, the seal 52 is disposed between a tapered surface 98 of the body 42 and the internal surface of the bore 40. More specifically, the tapered surface 98 includes a diameter that increases proximate the lower end 62 of the body 42. Accordingly, urging the seal 52 toward the lower end 62 and into engagement with the tapered face 98 (e.g., urging the seal in the direction of arrows 100) compresses (e.g., seats) the seal 52 between the tapered face 98 and the internal surface of the bore 40. In the seated position, the seal 52 provides a fluid seal that blocks fluids and gases from passing the BPV 12.

In one embodiment, the seal 52 is seated by a member that is urged in the direction of the arrow 100 to compress and seat the seal 52. For example, although not depicted in FIG. 2, as discussed in further detail with regard to FIGS. 3 and 4A-4E, in one embodiment, the outer sleeve 46 includes an extension that protrudes below the friction member 44 and into contact with the seal 52. Accordingly, the outer sleeve 46 is urged in the direction of the arrows 92 to seat the seal 52, in one embodiment. Further, as is discussed below, in one embodiment, the outer sleeve 46 includes a window such that movement of the outer sleeve 46 in the direction of the arrow 92, first, seats the seal 52, and, second, urges the friction member 44 into radial expansion.

Further, as discussed in detail with regard to FIGS. 3 and 4A-4E, the BPV 12 is disposed (e.g., run) into position within the bore and/or installed via one or more running tools. More specifically, in certain embodiment, a running tool couples to the upper end 60 of the BPV 12 to provide operation of the BPV 12 during installation and retrieval, among other operations. For example, as discussed below, a running tool urges the plunger 50 to an open position, runs the BPV 12 to the desired location, provides hydraulic pressure to engage the outer sleeve 46 to seat the seal 52 and radially expand the friction member 44 into contact with the bore 40, rotates the lock ring 48 to abut the outer sleeve 46, releases hydraulic pressure, urges the plunger 50 into a closed position, and disconnects itself from the BPV 12 before being extracted from the bore 40.

Although the previously discussed embodiments include operation of the friction member 44 as relying on longitudinal forces provided via the outer sleeve 46, the lock ring 48, and the body, it is worth noting that pressure acting on the BPV 12 provides for urging the friction member 44 into an expanded position. For example, in one embodiment, the pressure in the lower bore portion 58 acts on the lower end 62 of the body 42 of the BPV 12. Such a loading provides for urging the body 42 upward relative to the friction member 44. The upward movement along the longitudinal axis 54 provides for increasing the radial force (e.g., in the direction of arrows 90) acting on the friction member 44. Accordingly, as the pressure in the lower bore portion 58 increases, the radial expansion of the friction member 44 increases, thereby providing increased friction between the friction face 80 and the bore 40. In other words, as the pressure in the lower portion increases 58, the illustrated embodiment of the BPV 12 is secured even tighter into the bore 40, helping to prevent the BPV 12 from becoming dislodged.

Turning now to FIGS. 3 and 4A-4E, one embodiment of a BPV system 110 is depicted. More specifically, the illustrated embodiments include an installation sequence of a BPV system 110 including one embodiment of the BPV 12 and one embodiment of a back pressure valve (BPV) running tool 112. The BPV 12 includes features similar to those discussed above with regard to the BPV 12 of FIG. 2. For example, as depicted, the BPV 12 includes one embodiment of the body 42, the friction member 44, the outer sleeve 46, the lock ring 48, the plunger 50, and the seal 52.

In the illustrated embodiment, the body 42 includes a lower body portion 120 and an upper body portion 122. The lower body portion 120 includes the plunger bore 64. The plunger bore 64 includes a plunger bore sealing face 124. In the illustrated embodiment, the plunger bore sealing face 124 includes a taper between a lower plunger bore portion 126 and an upper plunger bore portion 128. The taper 124 includes an angled face (e.g., conical shaped face) that extends between the lower plunger bore portion 126 and the upper plunger bore portion 128. The taper 124 is shaped complementary to a plunger sealing face 130. In the illustrated embodiment, the upper plunger bore portion 128 is narrower (e.g., has a smaller diameter) than the lower plunger bore portion 126.

The lower body portion 120 also includes a holding ring 132 coupled to the lower end 62 of the lower body portion 120. The holding ring 132 is coupled to the lower body portion 120 via mechanical fasteners (e.g., bolts) 134. The holding ring 132 extends into the lower plunger bore portion 126 and includes a stem bore 135 that extends through the center of the holding ring 132 along the longitudinal axis 54. As is discussed in further detail below, the holding ring 132 retains the plunger 50 in the plunger bore 64.

The plunger 50 includes a stem 136, a bell 138, and a spring 140. The stem 136 is coupled to and extends downward form the bell 138. In the illustrated embodiment, the stem 136 is aligned along the longitudinal axis 54 and extends into the stem bore 135 of the holding ring 132. Further, the spring 140 is disposed around the stem 136 and is retained between the bell 138 and the holding ring 132. Accordingly, as the plunger 50 is urged toward the holding ring 132 (e.g., where the plunger 50 is urged to an open position), the spring 140 provides a biasing force urging the plunger 50 to a closed position (e.g., the sealing face 130 of the bell 138 into contact with the plunger bore sealing face 124.

In the illustrated embodiment, the bell 138 includes a seal 142 (e.g., annular seal) and a bell stem 144. The seal 142 generally includes a seal configured to seal against the plunger bore sealing face 124. The bell stem 144 includes a protrusion extended from the bell 138 in the direction of the upper plunger bore portion 128. In operation, the bell stem 144 enables a tool or similar device to engage the plunger via the upper plunger bore portion 128. For example, as is discussed in further detail below, in one embodiment, the running tool 112 is threaded into a thread 146 of the upper plunger bore 128 and depresses the plunger 50 via the bell stem 144, thereby urging the plunger 50 toward an open position.

The upper body portion 122 includes a cylindrical ring that is coupled to the lower body portion 120. In the illustrated embodiment, the upper body portion 122 includes a cylindrical ring that is disposed about an external diameter of an upper end 148 of the lower body portion 120. The upper body portion 122 is coupled to the lower body portion 120 via a mechanical fastener (e.g., a bolt) 150.

Further, the upper body portion 122 includes a hollow center 152. As is discussed in further detail below, the hollow center 152 is capable of receiving at least a portion of the BPV running tool 112. An upper body hydraulic port 154 extends from an interior surface of the hollow center 152 and extends through the upper body portion 122 to a lower end 156 of the upper body portion 122. The upper body hydraulic port 154 terminates into a cavity 158 formed between the upper body portion 122, the lower body portion 120 and the outer sleeve 46. The cavity 158 is sealed via three annular seals 160, 162 and 164 disposed between the upper body portion 122, the lower body portion 120 and the outer sleeve 46.

The friction member 44 includes, in the illustrated embodiment, segments disposed in the recess 66 of the lower body portion 120. The friction member 44 is coupled to the body 42 via fasteners (e.g., bolts) 166. The fasteners 166 are passed through through-holes 166. The through-holes 166 includes slots that enable the friction member 44 to move relative to the fasteners 166 and the body 42. More specifically, the friction member 44 is capable of being moved axially up and down in the recess to contract and expand, respectively, the friction member 44. For example, in the illustrated embodiment, the friction member 44 is in the radially contracted (e.g., up) position, and may be slid/urged into the radially expanded (e.g., down) position, as discussed previously with regard to FIG. 2.

The outer sleeve 46 includes a cylindrical body 170 disposed around the exterior of the body 42. In the illustrated embodiment, the outer sleeve 46 extends both above and below the friction member 44. For example, the body 170 of the outer sleeve 46 includes windows 172 that span the region proximate the friction member 44. More specifically, the windows 172 include cutouts through the body 170 that enable the outer sleeve 46 to slide in a longitudinal direction (e.g., parallel to the longitudinal axis 52) relative to the body 42 and/or the friction member 44. For example, the windows 172 include an upper window face 174 and a lower window face 176 that are separated by a distance that is greater than the height 88 of the friction member 44. Accordingly, in the illustrated embodiment, the outer sleeve 46 can be moved longitudinally downward for a distance before the upper face 174 of the body 170 contacts/engages the upper face 84 of the friction member 44. As is discussed below, this longitudinal movement can be employed to urge the seal 52 into a seated position. Further, the outer sleeve 46 can continue to move in the longitudinal downward direction to engage the upper face 84 of the friction member 44 and to cause the friction member to move downward in the recess 66 and expand radially, as discussed above with regard to FIG. 2.

In the illustrated embodiment, the seal 52 includes a MEC seal 52 disposed at a lower end 180 of the outer sleeve 46. As discussed previously, urging the outer sleeve 46 downward displaces the seal 52 downward along the longitudinal axis 54. As the seal 52 is urged downward, it is compressed between the tapered face 98 of the body 42 and the bore 40 until it is proximate and/or disposed in a seated position.

An upper end 182 of the outer sleeve 46 includes shear pin holes 184 that support shear pins 186 disposed between the outer sleeve 46 and the lock ring 48. Further, the upper end 182 includes a recess 188 that houses bearings 190 disposed between the outer sleeve 46 and the lock ring 48. Similarly, the lock ring 48 includes complementary shear pin holes 192 configured to support the shear pins 186 and a complementary bearing groove 194 that supports and houses the bearings 190.

The lock ring 48 includes a cylindrical ring that is disposed about the upper portion 122 of the body 42. In the illustrated embodiment, the lock ring 48 includes threads 196 about the internal diameter that are complementary to external threads 198 about the external diameter of the upper body portion 122. Accordingly, rotation of the lock ring 48 relative to the upper body portion 122 imparts a longitudinal movement of the lock ring 48 along the longitudinal axis 54. For example, rotating the lock ring 48 may secure the outer sleeve 46 in a locked position as discussed previously with regard to FIG. 2. Further, in the illustrated embodiment, the lock ring 48 includes axial slots 199. In operation, the slots 199 are engaged by complementary protrusions of the BPV running tool 112. The slots 199 transfer rotational torque from the BPV running tool 112 to the lock ring 48. Accordingly, rotation of the BPV running tool 112 imparts a rotation of the lock ring 48 via the slots 199, in one embodiment.

Figure 3:
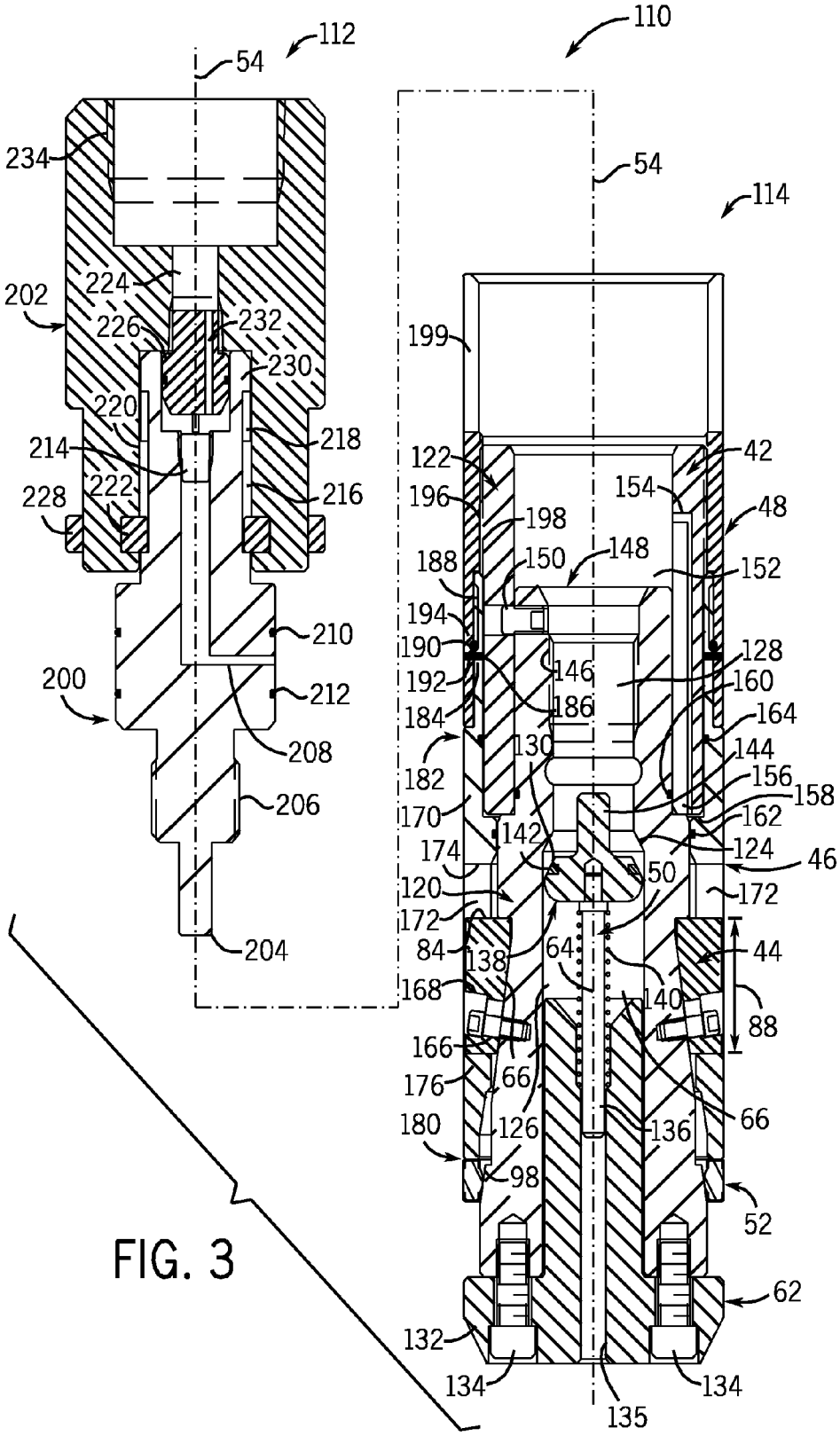
FIG. 3 is an exploded cross-sectioned view of a back pressure valve system in accordance with an embodiment of the present technique.

Turning now to the BPV running tool 112, as illustrated in FIG. 3, the BPV running tool 112 includes a lower tool portion 200 and an upper tool portion 202. The lower tool portion 200 includes a stem 204, a threaded portion 206, a hydraulic port 208, seals 210 and 212, a check valve 214, a groove 216, and slots 218. The upper body portion 202 includes a recess 220, internal protrusions 222, a port 224, a check valve stem 226, and external protrusions 228.

The stem 204 includes a protrusion along the longitudinal axis 54 and extending downward. In operation, the stem 204 engages the bell stem 144. In other words, as the BPV tool 112 is lowered into and/or engaged with the BPV 12, the stem 204 engages the bell stem 144, thereby urging the plunger 50 into the open position.

The threaded portion 206 includes an external thread that is complementary to the thread 146 of the upper plunger bore 128. Accordingly, rotation of the lower portion 200 of the BPV running tool 112 relative to the body 42 generates longitudinal movement of the lower portion of the BPV running tool 112 relative to the body 42 and the BPV 12. For example, prior to deploying the BPV 12 and the BPV running tool 112, the BPV running tool 112 is coupled to the BPV 12 via the threaded portion 206 and the thread 146 of the upper plunger bore 128. When threaded together, the longitudinal movement of the lower portion 200 of the BPV running tool 112 relative to the body 42 and the BPV 12 causes the stem 204 to urge the plunger 50 into an opened position.

The hydraulic port 208 includes a bore that extends from an upper end 230 of the lower portion 200 of the BPV running tool 112 and terminates in the external diameter of the lower body portion 200. In the illustrated embodiment, the hydraulic port 208 includes an L-shape that enables the port 208 to align with the hydraulic port 154 in the upper body portion 122 of the body 42 of the BPV 12. When the BPV 12 and the BPV running tool 112 are assembled, the two seals 210 and 212 flank the hydraulic ports 208 and 154 enabling pressurized fluid to pass between the ports 208 and 154. For example, as is discussed in further detail below, hydraulic fluid is injected into the cavity 158 via the hydraulic ports 154 and 208 to urge the outer sleeve 46 into a locked position.

Further, the check valve 214 is disposed in the hydraulic port 208. More specifically, the check valve 214 is disposed in the upper end 230 of the lower portion 200 of the BPV running tool 112. The check valve 214 helps to block hydraulic fluid from reversing in direction once injected into the hydraulic port 208. In other words, the check valve helps to maintain pressure within the hydraulic port 208. In operation, the check valve is opened via the check valve stem 226 that protrudes from the upper portion 202 of the BPV running tool 112. In the illustrated embodiment, the check valve stem 226 is disposed in the port 224 of the upper portion 202, and includes a port 232 that extends through its length. Accordingly, the check valve stem 226 engages the check valve 214 (e.g., depresses or moves the check valve 214 along the longitudinal axis 54, and enables hydraulic fluid to pass from the port 224 to the hydraulic port 208, in the illustrated embodiment.

The groove 216 of the lower portion 200 includes an annular recess in the circumference that is engaged by the internal protrusions 222 of the upper portion 202. The slots 218 include a plurality of depressions that extend upward from the groove 216 and are spaced around the circumference of the upper end 230 of the lower portion 200 of the BPV running tool 112. The slots 218 are sized such that the internal protrusions 222 engage the slots 218 when the upper portion 202 and the lower portion 200 are moved longitudinally relative to one another. For example, as is discussed in further detail below, the protrusions 222 include stems that extend inward into the groove 216 enabling the upper portion to rotate about the lower portion 200 in the illustrated position. Upward axial movement of the upper portion 202 causes the internal protrusions 222 to engage the slots 218, thereby enabling the rotational torque of the upper portion 202 to rotate the lower portion 200.

The external protrusions 228 include pins or similar extensions that protrude from the external diameter of the upper portion 202. As discussed previously, the external protrusions 228 are configured to engage the slots 199 of the locking ring 48. Accordingly, rotation of the upper portion 202 translates into rotation of the locking ring 48, in certain embodiments.

It is further noted that the upper portion 202 includes an attachment thread 234. The attachment thread 234 includes an internal thread that is couplable to casing, tubing, or a similar device employed to run the BPV 12 and/or the BPV running tool 112 into the bore 40. For example, casing is threaded into the attachment thread 234 to support the BPV running tool 112 and to provide for the delivery of hydraulic fluid in one embodiment.

Figure 4A:
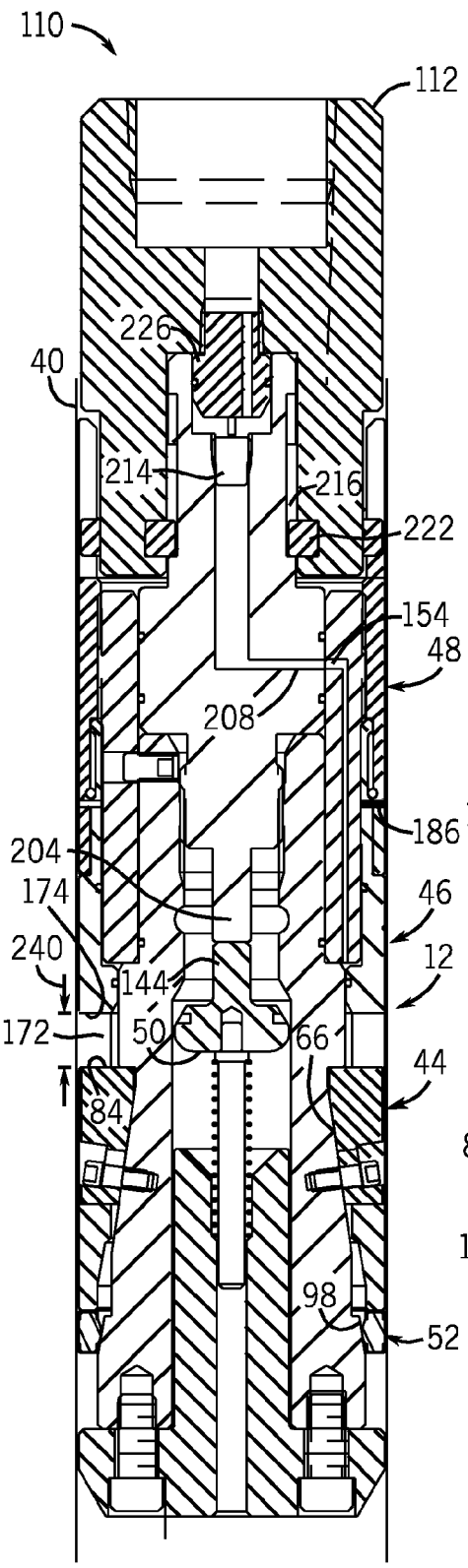
FIG. 4A-4E are cross-sectioned views of the back pressure valve system in accordance with embodiments of the present technique.
Figure 4B:
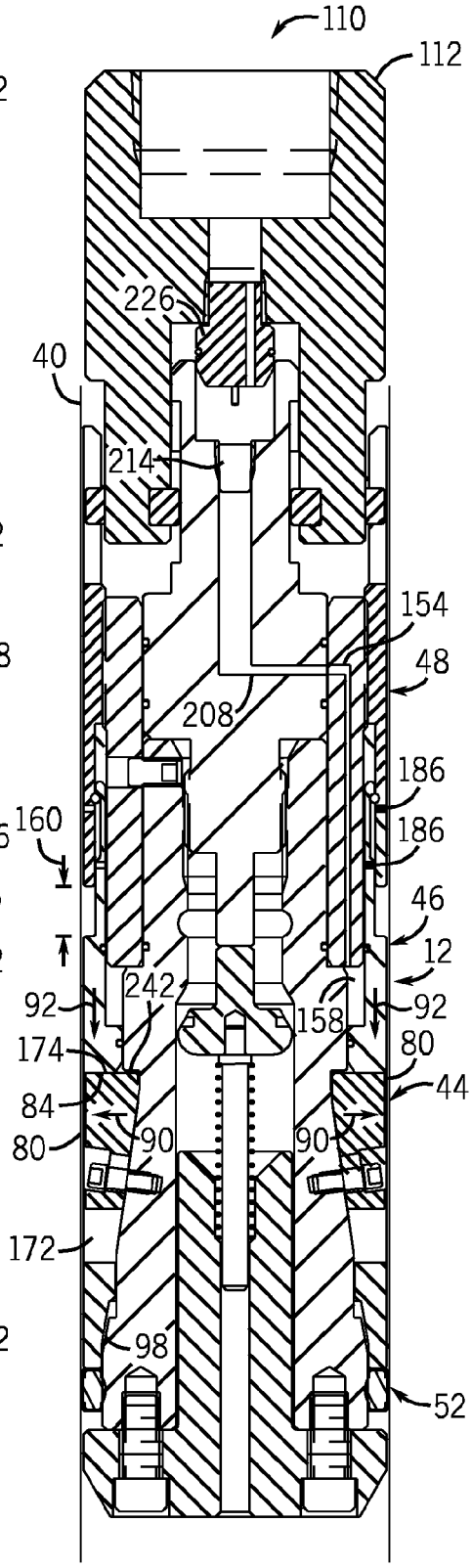
Figure 4C:
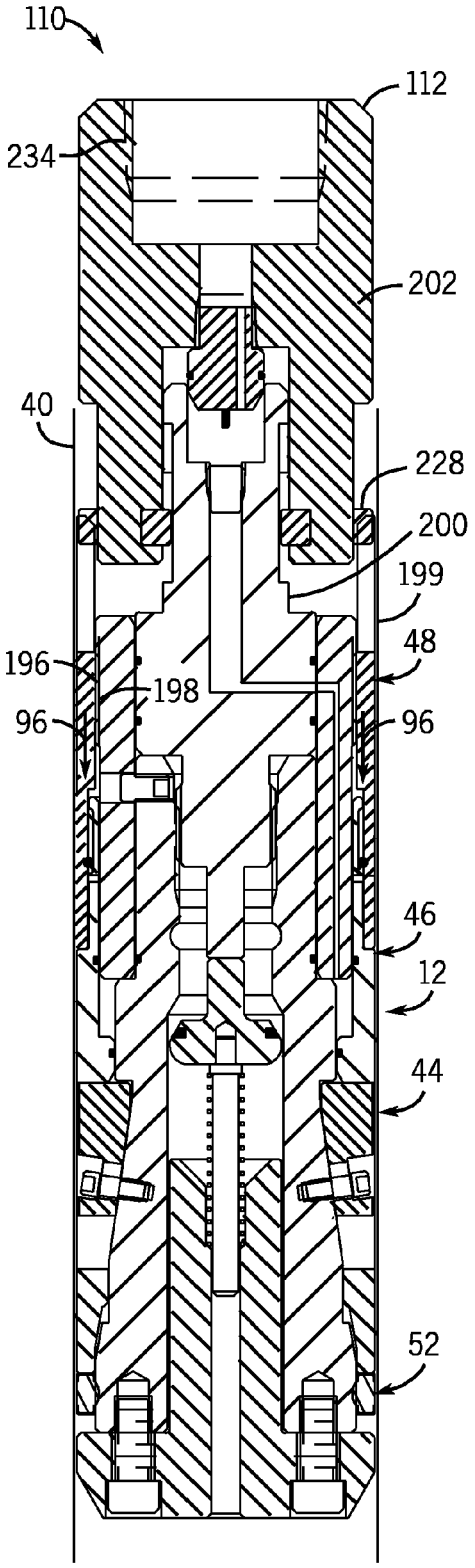

Turning now to FIG. 4A-4C a sequence of installing the BPV 12 is illustrated. FIG. 4A depicts the BPV 12 and the BPV running tool 112 assembled to one another and disposed in the straight bore 40. In the illustrated embodiment, the check valve stem 226 has engaged the check valve 214, the external protrusions 222 are located in the groove 216, the hydraulic port 208 of the BPV running tool 112 is aligned with the hydraulic port 154 of the body 42 of the BPV 12, the shear pins 186 are intact (e.g., un-sheared), the stem 204 of the BPV running tool 112 has engaged the bell stem 144 of the plunger 50 (e.g., urged/depressed the plunger 50 to the open position), the friction member 44 is disposed atop the recess 66 in the radially contracted position, a distance 240 exists between the upper face 84 of the friction member 44 and the upper window face 174, and the seal 52 is engaged by the taper 98 of the body 42. In other words, the BPV 12 is lowered into the bore 40 in a pre-landing position.

FIG. 4B depicts the BPV system 10 after hydraulic loading of the BPV system 110. In the illustrated embodiment, hydraulic fluid is injected into the cavity 158 via the hydraulic ports 208 and 154. As hydraulic fluid is injected into the cavity 158, the increase in pressure and volume causes a longitudinal downward force on the outer sleeve 42 in the direction of the arrows 92. The resulting downward force and movement of the outer sleeve 46 shears the shear pins 186, and urges the outer sleeve 46 downward in the direction of the arrows 92 into engagement with the friction member 44. In other words, the downward movement of the outer sleeve 46 eliminates the distance between the upper face 84 of the friction member 44 and the upper window face 174 until the upper window face 174 engages the upper face 84 of the friction member 44. The movement of the outer sleeve 42 creates a gap 160 between the lock ring 42 and the outer sleeve 46.

In the illustrated embodiment, the outer sleeve 46 continues to urge the friction member 44 downward, creating a gap 242 between the body 42 and the friction member 44 and radially expanding the friction member in the direction of the arrows 90. The radial expansion causes the friction face 80 of the friction member 44 to engage the internal diameter of the bore 40. Further, the seal 52 is driven longitudinally beyond the taper 98 in the body 42 into a seated position. In other words, the seal is compressed between the body 42 of the BPV 12 and the bore 40. With the cavity 158 pressurized and the outer sleeve 46 urged into the engage position, the BPV running tool 12 is moved up such that the check valve 214 is disengaged by the check valve stem 226. Accordingly, FIG. 4B depicts the BPV system 110 wherein the BPV 12 has been hydraulically pressurized, and the BPV running tool 112 is hydraulically disengaged from the BPV valve 12.

FIG. 4C depicts the lock ring 48 rotated into a locked position. For example, with the BPV 12 hydraulically pressurized, and the BPV running tool 112 hydraulically disengaged from the BPV valve 12, the upper portion 202 of the BPV running tool 112 is rotated. Rotation of the upper portion 202 of the BPV running tool 112 is provided via rotation of the casing, tubing, or other device coupled to the attachment threads 234, in one embodiment. Accordingly, rotational torque generated by rotating the upper portion 202 of the BPV running tool 112 is transferred to the slots 199 of the locking ring 48 via the external protrusions 228. The resulting rotation of the lock ring 48 about the threads 196 and 198 causes the locking ring 48 to move longitudinally downward in the direction of the arrows 96. The rotation is continued until the lock ring 48 is proximate or engages the outer sleeve 46. In other words, the gap 160 is reduced and/or eliminated. Accordingly, the illustrated embodiment includes the lock ring 48 moved into a locked position. In the locked position, the lock ring 48 abuts the outer sleeve 46, thereby securing the outer sleeve 46 and the friction member 44 in the radially expanded position.

Figure 4D:
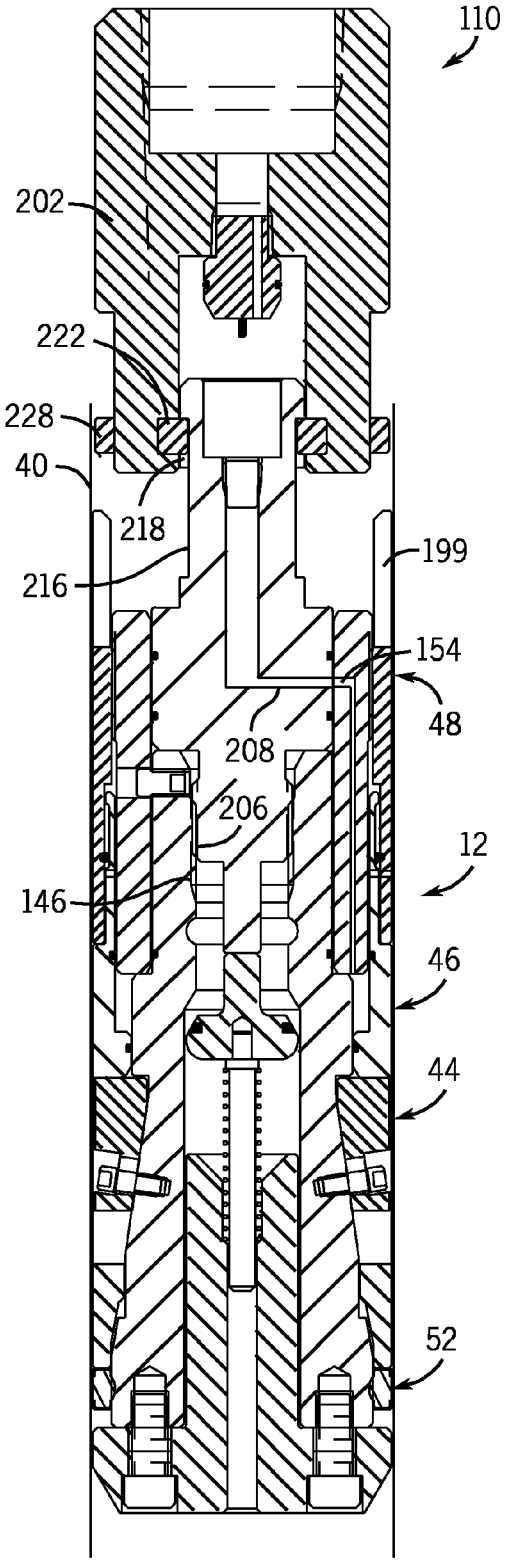

FIG. 4D depicts the upper portion 202 of the BPV running tool 112 moved upward such that the internal protrusions 222 are disengaged from the groove 216 and have engaged the slots 218 located above the groove 216. In other words, once the lock ring 48 is disposed in the locked position, the upper portion 202 of the BPV running tool 112 is retracted upward such that the external protrusions 220 disengage the slots 199 of the lock ring 48 and the internal protrusions 222 engage the slots 218 of the lower portion 200 of the BPV running tool 112. With the internal protrusions 222 engaged in the slots 218, the upper portion of the BPV running tool 112 is rotated, for example, via rotation of the casing, tubing, or other device coupled to the attachment threads 234, causing rotation of the lower portion 200 of the BPV running tool 112 that disengages the threaded portion 206 of the lower portion of the BPV running tool 112 to disengage threads 146 in the body 42 of the BPV 12. Accordingly, rotation of the BPV running tool 112 longitudinally disengages the BPV running tool 112 from the BPV 12. In one embodiment, once the BPV running tool 112 is disengaged from the BPV 12, the BPV running tool 112 is retrieved/extracted (e.g., retrieved to a vessel in a subsea system 10).

Figure 4E:
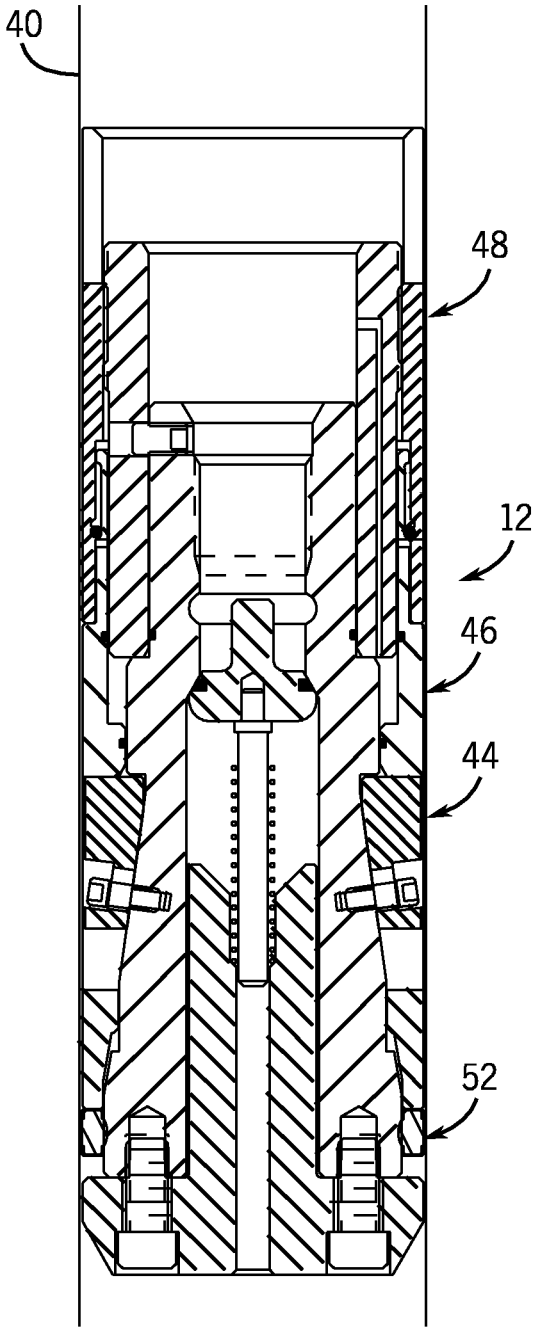

FIG. 4E depicts an embodiment wherein the BPV 12 is installed in the straight bore 40 and the BPV running tool 112 is disengaged and retrieved from the bore 40. More specifically, the friction member 44 is radially expanded into engagement with the internal surface of the bore 40, the lock ring 48 is set in the locked position, the seal 52 is seated, and the BPV running tool 112 is retrieved from the bore 40.

As discussed above with regard to FIG. 2, the embodiments discussed with regard to FIGS. 3 and 4A-4E may include any combination or variation of features. For example, the embodiments may include various configurations of the friction member 44 (e.g., a C-Ring, segments, and/or locking dogs). Further, the friction face 80 may include any variety or combination of surface finishes (e.g., scoring, grooves, teeth, etc.). In addition, the seal 52 may include a MEC seal and/or a LS seal. Further, although not depicted, retrieval of the tool may generally include the BPV running tool 112 being lowered to the BOV 12, rotating the BPV running tool 112 to back-off the lock ring 48 and relieve the longitudinal force holding the outer sleeve 46 and the friction member 44 in place, and extraction of the BPV 12 and the BPV running tool 112 via the bore 40.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a back pressure valve, comprising:

a body;

a plunger disposed internal to the body;

a friction member disposed about the exterior of the body, wherein the friction member is configured to move in response to a hydraulic pressure in a hydraulic cavity, the friction member is configured to expand radially from a radially contracted position to a radially expanded position to contact an internal surface of a straight bore to secure the back pressure valve in the straight bore, and the friction member is configured to contract radially from the radially expanded position to the radially contracted position to disengage the internal surface of the straight bore to release the back pressure valve from the straight bore; and a lock member configured to lock the friction member in the radially expanded position, wherein the back pressure valve is configured to be retrieved from the straight bore after releasing the lock member and contracting the friction member from the radially expanded position to the radially contracted position.

2. The system of claim 1, comprising the straight bore, wherein the friction member is radially expanded in the straight bore.

3. The system of claim 1, wherein the body comprises a recess and the friction member is disposed in the recess.

4. The system of claim 3, wherein the recess comprises a tapered face angled relative to a longitudinal axis of the back pressure valve and the friction member comprises a complementary tapered face.

5. The system of claim 4, wherein the friction member is configured to expand radially in response to movement along the recess in a direction generally along the longitudinal axis of the back pressure valve.

6. The system of claim 1, wherein the friction member comprises a plurality of segments.

7. The system of claim 1, wherein the friction member comprises a C-ring.

8. The system of claim 1, comprising an outer sleeve disposed about the exterior of the body, wherein the outer sleeve is configured to move along a longitudinal axis of the back pressure valve to move the friction member between the radially contracted position and the radially expanded position.

9. The system of claim 8, wherein the outer sleeve is configured to move in response to the hydraulic pressure in the hydraulic cavity between the outer sleeve and the body.

10. The system of claim 8, comprising a seal disposed about the exterior of the body, wherein the outer sleeve is configured to move along the longitudinal axis of the back pressure valve to move the seal between an unseated position and a seated position relative to the internal surface of the bore.

11. The system of claim 10, wherein the outer sleeve comprises a window, the friction member is configured to move radially within the window, the seal is disposed on a first axial side of the window, and the lock member is disposed on a second axial side of the window opposite from the first axial side.

12. The system of claim 11, wherein the outer sleeve is configured to move in response to a hydraulic pressure in a hydraulic cavity between the outer sleeve and the body, the lock member is coupled to the body via mating threads, the lock member is configured to rotate along the mating threads to bias the outer sleeve axially toward the friction member to hold the friction member in the radially expanded position, and the lock member is configured to rotate along the mating threads to enable the outer sleeve to move axially away from the friction member to enable the friction member to move to the radially contracted position.

13. The system of claim 8, wherein the lock member comprises a locking ring configured to rotate about the longitudinal axis between a locked position and an unlocked position, the locked position of the locking ring corresponds to the radially expanded position of the friction member, and the unlocked position of the locking ring corresponds to the radially contracted position of the friction member.

14. The system of claim 13, wherein the locking ring is coupled to the body via mating threads, and the locking ring is coupled to the outer sleeve via at least one shear pin.

15. The system of claim 1, wherein the back pressure valve is coupled to a Christmas tree, a wellhead, or a combination thereof.

16. A system, comprising:

a back pressure valve, comprising:

a body comprising a plunger bore through an interior of the body and a recess about an exterior of the body, wherein the recess comprises a tapered external face angled relative to a longitudinal axis of the back pressure valve;

a plunger disposed in the plunger bore, wherein the plunger is spring-loaded by a spring, and the plunger is configured to move in response to fluid pressure overcoming a spring bias of the spring;

a friction member disposed in the recess, wherein the friction member comprises a complementary tapered internal face that abuts the tapered external face and an external friction face, wherein the friction member is configured to move between a radially expanded position having the external friction face engaged with a straight bore and a radially contracted position having the external friction face disengaged from the straight bore; and a lock member configured to lock the friction member in the radially expanded position to secure the back pressure valve within the straight bore, wherein the back pressure valve is configured to be retrieved from the straight bore after releasing the lock member and contracting the friction member from the radially expanded position to the radially contracted position.

17. The system of claim 16, wherein the back pressure valve comprises:

a seal disposed about the exterior of the body; and a sleeve disposed about the longitudinal axis, wherein the sleeve is configured to move along the longitudinal axis to move the friction member between the radially contracted position and the radially expanded position, and the sleeve is configured to move along the longitudinal axis to move the seal between an unseated position and a seated position.

18. The system of claim 17, wherein the sleeve comprises a window, the friction member is configured to move radially within the window, and the sleeve is a one-piece structure.

19. The system of claim 16, wherein the external friction face comprises a coating.

20. The system of claim 19, wherein the coating comprises a composite material.

21. The system of claim 19, wherein the coating has a coating hardness less than a surface hardness of the straight bore.

22. The system of claim 16, wherein the back pressure valve is coupled to a Christmas tree, a wellhead, or a combination thereof.

23. The system of claim 16, wherein the external friction face comprises a straight cylindrical surface having a coarse surface finish.

24. A system, comprising:

a back pressure valve, comprising:

a body comprising a central bore and an external groove and a hydraulic port, wherein the external groove comprises a tapered external face;

a friction member disposed in the external groove, wherein the friction member comprises:

a tapered internal face that is complementary to the tapered external face;

an external friction ring face;

an upper friction ring face, and a lower friction ring face;

an outer sleeve disposed about the exterior of the body and between the locking ring and the friction member, and comprising a window disposed on two sides of the friction member;

a plunger disposed in the central bore of the body;

a locking ring comprising a slot and disposed about the exterior of the body; and a back pressure valve running tool, comprising:

a first body portion, comprising:

a stem that protrudes along a longitudinal axis of the first body portion;

a complementary hydraulic port that passes through the first body portion and that is configured to align with the hydraulic port of the body of the back pressure valve;

a check valve disposed in the hydraulic port;

a shoulder configured to transfer a load parallel to the longitudinal axis of the first body portion; and slots configured to transfer between the first body portion and internal protrusions of a second body portion a rotational torque about the longitudinal axis of the first body portion; and the second body portion comprising the internal protrusions and external protrusions configured to transfer a rotational torque to the slot of the locking ring of the back pressure valve.

25. The system of claim 24, wherein the friction member is configured to expand radially to secure the back pressure valve to a bore, and the friction member is configured to contract radially to release the back pressure valve from the bore to enable retrieval of the back pressure valve from the bore, wherein the outer sleeve is configured to move in response to a hydraulic pressure from the hydraulic port, wherein the locking ring is configured to selectively hold the outer sleeve.

26. The system of claim 24, wherein the back pressure valve is coupled to a Christmas tree, a wellhead, or a combination thereof.

27. A system, comprising:

a back pressure valve, comprising:

a body comprising a recess about an exterior of the body, wherein the recess comprises an tapered external face angled relative to a longitudinal axis of the back pressure valve;

a friction member disposed in the recess, wherein the friction member comprises a complementary tapered internal face that abuts the tapered external face, and an external friction face of the friction member comprises a coarse texture, wherein the friction member is configured to move between a radially expanded position having the coarse texture engaged with a bore and a radially contracted position having the coarse texture disengaged from the bore; and a lock member configured to lock the friction member in the radially expanded position to secure the back pressure valve within the bore, wherein the back pressure valve is configured to be retrieved from the bore after releasing the lock member and contracting the friction member from the radially expanded position to the radially contracted position;

wherein the back pressure valve is coupled to a Christmas tree, a wellhead, or a combination thereof.

28. The system of claim 27, wherein the coarse texture comprises a coarse surface finish disposed on a straight cylindrical surface of the external friction face.

29. A system, comprising:

a back pressure valve, comprising:

a body;

a plunger disposed internal to the body;

a friction member disposed about the exterior of the body, wherein the friction member comprises a C-ring, the friction member is configured to expand radially from a radially contracted position to a radially expanded position to contact an internal surface of a straight bore to secure the back pressure valve in the straight bore, and the friction member is configured to contract radially from the radially expanded position to the radially contracted position to disengage the internal surface of the straight bore to release the back pressure valve from the straight bore; and a lock member configured to lock the friction member in the radially expanded position, wherein the back pressure valve is configured to be retrieved from the straight bore after releasing the lock member and contracting the friction member from the radially expanded position to the radially contracted position.

30. A system, comprising:

a back pressure valve, comprising:

a body;

a plunger disposed internal to the body;

a friction member disposed about the exterior of the body, wherein the friction member is configured to expand radially from a radially contracted position to a radially expanded position to contact an internal surface of a straight bore to secure the back pressure valve in the straight bore, and the friction member is configured to contract radially from the radially expanded position to the radially contracted position to disengage the internal surface of the straight bore to release the back pressure valve from the straight bore;

an outer sleeve disposed about the exterior of the body, wherein the outer sleeve is configured to move along a longitudinal axis of the back pressure valve to move the friction member between the radially contracted position and the radially expanded position; and a lock member configured to lock the friction member in the radially expanded position, wherein the back pressure valve is configured to be retrieved from the straight bore after releasing the lock member and contracting the friction member from the radially expanded position to the radially contracted position.

31. A system, comprising:

a back pressure valve, comprising:

a body comprising a recess about an exterior of the body, wherein the recess comprises a tapered external face angled relative to a longitudinal axis of the back pressure valve;

a friction member disposed in the recess, wherein the friction member comprises a complementary tapered internal face that abuts the tapered external face, and an external friction face of the friction member comprises a coating, wherein the friction member is configured to move between a radially expanded position having the coating engaged with a straight bore and a radially contracted position having the coating disengaged from the straight bore; and a lock member configured to lock the friction member in the radially expanded position to secure the back pressure valve within the straight bore, wherein the back pressure valve is configured to be retrieved from the straight bore after releasing the lock member and contracting the friction member from the radially expanded position to the radially contracted position.

32. The system of claim 31, wherein the external friction face comprises a coarse texture having the coating.

* * * * *